United States Patent [19]

Rhein et al.

[11] Patent Number: 4,481,119

[45] Date of Patent: Nov. 6, 1984

[54] COMPOSITIONS FOR EXTINGUISHING TITANIUM FIRES

[75] Inventors: Robert A. Rhein; James C. Baldwin; Charles L. Beach, all of Ridgecrest, Calif.

[73] Assignee: The United States of America as represented by the Secretary of the Navy, Washington, D.C.

[21] Appl. No.: 474,414

[22] Filed: Mar. 11, 1983

[51] Int. Cl.[3] ..... A62D 1/00

[52] U.S. Cl. ..... 252/2; 169/46; 169/47

[58] Field of Search ..... 252/2, 3, 5, 605; 169/47, 46; 106/15.05

[56] References Cited

U.S. PATENT DOCUMENTS

| | | | |
|---|---|---|---|
| 2,787,329 | 4/1957 | Schechter | 169/1 |
| 3,475,332 | 10/1969 | Leeper et al. | 252/2 |
| 3,947,365 | 3/1976 | Cottrell et al. | 252/7 |
| 3,961,964 | 6/1976 | Achter et al. | 106/15 FP |
| 3,983,040 | 9/1976 | Draganov | 252/8.1 |
| 4,020,903 | 5/1977 | Fielding et al. | 252/3 |
| 4,078,953 | 3/1978 | Sayles | 149/20 |
| 4,149,976 | 4/1979 | Reuillon et al. | 252/2 |
| 4,177,152 | 12/1979 | Sarrut | 252/2 |
| 4,382,884 | 5/1983 | Rohringer et al. | 252/606 |

OTHER PUBLICATIONS

Stobridge et al., 1979, Titanium Combustion in Turbine Engines, Report Nos. FAA-RD-79-51, NBS1R 79-1616, U.S. Department of Transportation, Washington, D.C.

Smith, A. J. et al., "Comparison Tests for Extinguishing Media on Metal Fires" AERE R 6745, Apr. 1971.

*Primary Examiner*—Stephen J. Lechert, Jr.
*Assistant Examiner*—Howard J. Locker
*Attorney, Agent, or Firm*—Robert F. Beers; W. Thom Skeer; Bruce H. Cottrell

[57] ABSTRACT

Titanium metal fires are extinguished by the application of a material selected from the group consisting of calcium fluoride, lithium fluoride and sodium fluoride.

3 Claims, No Drawings

COMPOSITIONS FOR EXTINGUISHING TITANIUM FIRES

BACKGROUND OF THE INVENTION

1. Field of the Invention

This invention relates to methods of extinguishing titanium metal fires. More particularly, this invention relates to methods of extinguishing titanium metal fires in a flowing airstream.

2. Description of the Prior Art

Titanium is a low density, high strength metal which has found increasing utilization in the aerospace industry. Although displaying excellent corrosive (oxidation) resistance at normal temperatures and air pressures, the bulk metal is subject to sustained combustion in pure oxygen and/or pressurized air once sufficient energy for ignition has been obtained. One such critical environment for titanium combustion exists in the high pressure compressor sections of gas turbine engines. Titanium has been a material of choice here for weight reduction. However, sufficient energy to cause ignition is obtainable through foreign object damage, blade rubs or strikes, or a blade failure. Once ignited, titanium is actually a very energetic metal and will burn in oxygen and/or nitrogen at a very high temperature (5300° F.) as long as sufficient pressure is maintained. Many conventional extinguishants are not effective and may even be hazardous against titanium fires.

Several specific extinguishants have proven useful in combating titanium fires. Examples include the liquid extinguishant trimethoxyboroxine and the solid extinguishants sodium chloride and graphite carbon. However, no specific extinguishant for titanium fires has been designed for use in a pressurized, flowing airstream.

SUMMARY OF THE INVENTION

This invention provides a method of extinguishing a titanium metal fire in a flowing airstream by injecting an extinguishant selected from the group consisting of calcium flouride, lithium fluoride and sodium fluoride into the airstream at a point upstream of the titanium metal fire.

OBJECTS OF THE INVENTION

It is an object of this invention to provide a method of extinguishing a titanium metal fire. Another object of this invention is a method of extinguishing a titanium metal fire in a flowing airstream. Still another object of this invention is to provide extinguishants effective against a titanium metal fire in a flowing airstream.

Other objects, advantages and novel features of the invention will become apparent from the following detailed description of the invention.

DESCRIPTION OF THE PREFERRED EMBODIMENT

It has been found that the solid materials calcium fluoride, lithium fluoride and sodium fluoride are all effective in extinguishing titanium metal fires in a flowing airstream.

Thermochemical calculations were conducted (see D. R. Cruise, Theoretical Computations of Equilibrium Compositions, Thermodynamic Properties, and Performance Characteristics of Propellant Systems, Naval Weapons Center Technical Publication 6037, April 1979) to find the anticipated temperature resulting when a titanium fire model of $\frac{2}{3}Ti+\frac{1}{3}TiO_2$ and of $\frac{1}{3}Ti+\frac{2}{3}TiO_2$ at a typical burning temperature of 3200° K. was treated with a selected weight mass of an extinguishant. As an example, at 50 weight percent extinguishant, half the mass was extinguishant and the other half was the titanium fire model composition. The predicted effectiveness of the extinguishants of this invention are shown in Table 1. The previously known titanium fire extinguishants of trimethoxyboroxine (TMB) and sodium chloride are included for comparison. The resulting computed temperature was desired to be below 1900°-2000° K., the generally accepted value for the ignition temperature of titanium in air.

TABLE 1

| | Titanium Fire Model | | | |
|---|---|---|---|---|
| | $\frac{2}{3}$ Ti + $\frac{1}{3}$ $TiO_2$ | | $\frac{1}{3}$ Ti + $\frac{2}{3}$ $TiO_2$ | |
| Extinguishant | wt. % ext. | Temp. °K. | wt. % ext. | Temp. °K. |
| LiF (s) | 20 | 1352 | 30 | 1182 |
| $CaF_2$ (s) | 30 | 954 | 30 | 1489 |
| NaF (s) | 30 | 1695 | 40 | 1897 |
| TMB (l) | 40 | 1842 | 40 | 1424 |
| NaCl (s) | 40 | 1764 | 50 | 2003 |

To determine the effectiveness of these extinguishants in putting out titanium fires in a flowing airstream such as that found in turbine engines, it was necessary to simulate turbine engine compressor conditions with a test apparatus. The test apparatus for the titanium fires included an air system adapter, an extinguishant delivery system, a test chamber, an ignition system and a control system. Within the test chamber a 1/16-inch by 2-inch by 3-inch Ti-6Al-4V alloy specimen was held with the 2-inch dimension vertical and the 3-inch dimension parallel to the airflow. (Ti-6Al-4V is an alloy commonly used in airplane turbine parts containing 90% titanium, 6% aluminum and 4% vanadium.) An observation port into the test chamber allowed for the collection of data by high speed movie film (400 frames/second). The airflow in the system was obtained by expansion from large pressurized storage tanks. The cold air (around 0° F.) was used directly or heated by burning fuel directly in the airstream. Depleted oxygen was made up to the original oxygen concentration from a pressurized supply. The ignition system was a portable 180 amp DC arc welder to ignite the titanium specimen. A powdered solids extinguisher system was used to deliver the extinguishants into the flow stream at a flow rate of approximately 1 lb/sec or 5.8 g/cm$^2$-sec.

The experimental sequence for testing in the titanium fire testing was as follows. Air was adjusted to the desired chamber temperature and static pressure. The camera was started and then the sample was ignited by the electric arc. The airflow was then directed through the test chamber and sustained combustion took place. The extinguishants were then injected upstream of the fire to determine their effectiveness as the material was carried by the airstream to the titanium fire.

The method of testing the extinguishants involved finding the minimum amount which would put out the titanium fire in 50% or more of the attempts with each extinguishant. High speed movie film provided data on ignition, the initial burning rate, and the condition of the titanium fire extinction. The extinguishants of Table 1 were all tested to determine the effective amounts needed. Calcium fluoride was the most effective extinguishant found. It was effective in the amount of 75 grams to put out the titanium specimen in at least half of the attempts. Both lithium fluoride and sodium fluoride were effective at the amount of 100 grams. By comparison, sodium chloride required 150 grams and the trimethoxyboroxine required 456 grams for 50% effectiveness.

Calcium fluoride is the most preferred extinguishant for use on titanium fires. It was found the most effective requiring the smallest weight of material. Further, as calcium fluoride has a low solubility in water, the use of calcium fluoride results in a reasonable low toxicity level. Lithium fluoride and sodium fluoride are also effective at combating titanium fires in an airstream.

Obviously many modifications and variations of the present invention are possible in light of the above teachings. In particular, delivery flow rates of extinguishant and the use of certain particle sizes and particle size distributions can be varied to optimize extinguishant performance. It is therefore to be understood that within the scope of the appended claims the invention may be practiced otherwise than as specifically described.

What is claimed is:

1. A method of extinguishing a titanium metal fire in a flowing airstream comprising the step of:

injecting an extinguishant selected from the group consisting of calcium fluoride, lithium fluoride and sodium fluoride into the airstream at a point upstream of said fire.

2. A method of extinguishing a titanium metal fire in a flowing airstream comprising the step of:

injecting an extinguishant of calcium fluoride into the airstream at a point upstream of said fire.

3. A method of extinguishing a titanium metal fire comprising the step of:

applying an extinguishant selected from the group consisting of calcium fluoride, lithium fluoride and sodium fluoride to said fire.

* * * * *